US010286654B2

(12) United States Patent
Mizutani

(10) Patent No.: US 10,286,654 B2
(45) Date of Patent: May 14, 2019

(54) INKJET RECORDING DEVICE AND INK-DISCHARGE ADJUSTMENT METHOD FOR INKJET RECORDING DEVICE

(71) Applicant: Konica Minolta, Inc., Tokyo (JP)

(72) Inventor: Toshiyuki Mizutani, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/760,481

(22) PCT Filed: Sep. 6, 2016

(86) PCT No.: PCT/JP2016/076136
§ 371 (c)(1),
(2) Date: Mar. 15, 2018

(87) PCT Pub. No.: WO2017/047448
PCT Pub. Date: Mar. 23, 2017

(65) Prior Publication Data

US 2018/0250932 A1 Sep. 6, 2018

(30) Foreign Application Priority Data

Sep. 17, 2015 (JP) ..... 2015-183827

(51) Int. Cl.
*B41J 2/045* (2006.01)
*B41J 2/01* (2006.01)
(Continued)

(52) U.S. Cl.
CPC ..... *B41J 2/04541* (2013.01); *B41J 2/01* (2013.01); *B41J 2/045* (2013.01); *B41J 2/04573* (2013.01);
(Continued)

(58) Field of Classification Search
CPC .... B41J 2/045; B41J 2/04541; B41J 2/04573; B41J 2/2139; B41J 2/2146; B41J 2/2142
(Continued)

(56) References Cited

U.S. PATENT DOCUMENTS

2009/0244153 A1 10/2009 Miyamoto

FOREIGN PATENT DOCUMENTS

JP 2007160779 A 6/2007
JP 2013103339 A 5/2013

OTHER PUBLICATIONS

International Preliminary Report on Patentability dated Nov. 22, 2016 from the corresponding International Application No. PCT/JP2016/076136 and English translation.
(Continued)

*Primary Examiner* — An H Do
(74) *Attorney, Agent, or Firm* — Lucas & Mercanti, LLP

(57) ABSTRACT

An inkjet recording device includes a hardware processor. The hardware processor: performs, for respective recording heads of a recorder, setting relevant to adjustment of an amount of ink to be discharged from nozzle groups; based on ink discharge amount information on a distribution of ink discharge amounts that are discharged from the nozzle groups based on image data, performs the setting such that at each joint in the nozzle groups, a difference between representative values of the ink discharge amounts of the nozzle groups satisfies a predetermined continuity condition, and a representative value of the ink discharge amounts of the nozzle groups satisfies a predetermined discharge amount condition; and adjusts at least a part of the setting such that a difference between a maximum value and a minimum value of the ink discharge amounts of the nozzle groups reduces.

11 Claims, 6 Drawing Sheets

(51) Int. Cl.

| | |
|---|---|
| ***B41J 2/135*** | (2006.01) |
| ***B41J 2/21*** | (2006.01) |
| ***B41J 2/36*** | (2006.01) |

(52) U.S. Cl.
CPC ..... *B41J 2/04586* (2013.01); *B41J 2/04588* (2013.01); *B41J 2/135* (2013.01); *B41J 2/2146* (2013.01); *B41J 2/362* (2013.01); *B41J 2202/01* (2013.01)

(58) Field of Classification Search
USPC ..... 347/9–11, 14, 19
See application file for complete search history.

(56) References Cited

OTHER PUBLICATIONS

Extended European Search Report dated Sep. 14, 2018 from the corresponding European Application No. 16846319.8.
International Search Report dated Nov. 22, 2016 for PCT/JP2016/076136 and English translation.
Office Action dated Dec. 17, 2018 from the corresponding Chinese Patent Application No. 201680054386.1 and English translation.

INKJET RECORDING DEVICE AND INK-DISCHARGE ADJUSTMENT METHOD FOR INKJET RECORDING DEVICE

CROSS REFERENCE TO RELATED APPLICATION

This Application is a 371 of PCT/JP2016/076136 filed on Sep. 6, 2016, which, in turn, claimed the priority of Japanese Patent Application No. JP 2015-183827 filed on Sep. 17, 2015, both applications are incorporated herein by reference.

TECHNICAL FIELD

The present invention relates to an inkjet recording device and an ink-discharge adjustment method for an inkjet recording device(s).

BACKGROUND ART

There are conventional inkjet recording devices each of which records images by, while moving a recording head that discharges ink and has a plurality of nozzles and a recording medium relative to one another, discharging the ink to the recording medium from the nozzles of the recording head. Nowadays, as to this type of inkjet recording device, in order to meet a demand on increase in recording speed, a long head unit(s) (recorder(s)) in which recording heads are arranged at different positions in the width direction that intersects the direction of the above relative movement is formed, and a technique of discharging ink from nozzles disposed in each of the recording heads of the long recorder(s), thereby recording images, is used.

In inkjet recording devices, variation in ink discharge amount among nozzles of a recording head leads to decrease in image quality. Further, if the number of recording heads is two or more, variation in the discharge amount among the recording heads tends to occur. To deal with this, there is a technique of performing adjustment to suppress variation in the amount of ink to be discharged from nozzles of recording heads, thereby suppressing decrease in quality of recorded images.

For example, there is disclosed in Patent Document 1 a technique of controlling a drive operation for a portion(s) of an image recorded by recording heads of a recorder on the basis of image data having a predetermined density, the portion where the actual density departs from the overall average range.

Further, there is disclosed in Patent Document 2 a technique of controlling a drive operation for each recording head such that at a joint in nozzles of recording heads, the actual density value of an image having a predetermined density recorded with ink discharged from the nozzles of one recording head matches the density value of the image having the predetermined density recorded with the ink discharged from the nozzles of the other recording head.

RELATED ART DOCUMENTS

Patent Documents

Patent Document 1: Japanese Patent Application Publication No. 2013-103339

Patent Document 2: Japanese Patent Application Publication No. 2007-160779

SUMMARY OF THE INVENTION

Problems to be Solved by the Invention

However, if ink discharge amounts are adjusted for some of recording heads by the technique disclosed in Patent Document 1, differences between the ink discharge amounts are generated locally at joints in nozzles of the recording heads.

Meanwhile, if density unevenness at joints in nozzles of recording heads is solved by the technique disclosed in Patent Document 2, ink discharge amounts of the recording heads become unequal to one another according to differences between the ink discharge amounts at the both ends of the nozzles of the recording heads.

Thus, inkjet recording devices each including a long recorder(s) constituted of a plurality of recording heads have a problem of not being able to avoid decrease in quality of recorded images due to unequal ink discharge amounts of the recording heads.

Objects of the invention include providing an inkjet recording device and an ink-discharge adjustment method for an inkjet recording device(s) that can more effectively suppress decrease in quality of images to be recorded by a long recorder(s) having a plurality of recording heads.

Means for Solving the Problems

One aspect of the invention is an inkjet recording device including:

a recorder that discharges an ink to a recording medium from nozzles disposed in each of recording heads; and a setting section that performs, for the respective recording heads, setting relevant to adjustment of an amount of the ink to be discharged from nozzle groups each constituted of at least a part of the nozzles, which are disposed in each of the recording heads, wherein the recording heads are disposed such that arrangement regions of the nozzle groups in a predetermined direction, the nozzle groups corresponding to the respective recording heads, include regions different from one another, and ink dischargeable regions are connected to one another to be continuous in the predetermined direction, and the setting section performs:

a first adjustment operation, thereby, based on ink discharge amount information on a distribution in the predetermined direction of ink discharge amounts that are discharged from the nozzle groups based on image data having a predetermined density, performing the setting for the respective recording heads such that at each joint of joints in the nozzle groups in the predetermined direction, a difference between representative values of the ink discharge amounts satisfies a predetermined continuity condition, each joint being formed by a pair of the nozzle groups, and a representative value of the ink discharge amounts of all the nozzle groups satisfies a predetermined discharge amount condition for the predetermined density; and after the first adjustment operation, a second adjustment operation, thereby adjusting at least a part of the setting, which has been performed for the respective recording heads, such that a difference between a maximum value and a minimum value of the ink discharge amounts of the nozzle groups reduces.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

EMBODIMENTS FOR CARRYING OUT THE INVENTION

Hereinafter, one or more embodiments of the present invention will be described with reference to the drawings. However, the scope of the invention is not limited to the disclosed embodiments.

Hereinafter, one or more embodiments of an inkjet recording device and an ink-discharge adjustment method for an inkjet recording device(s) of the invention are described on the basis of the drawings.

One aspect of the invention has an effect of more effectively suppressing decrease in quality of images to be recorded by a long recorder(s) having a plurality of recording heads.

Figure 1:
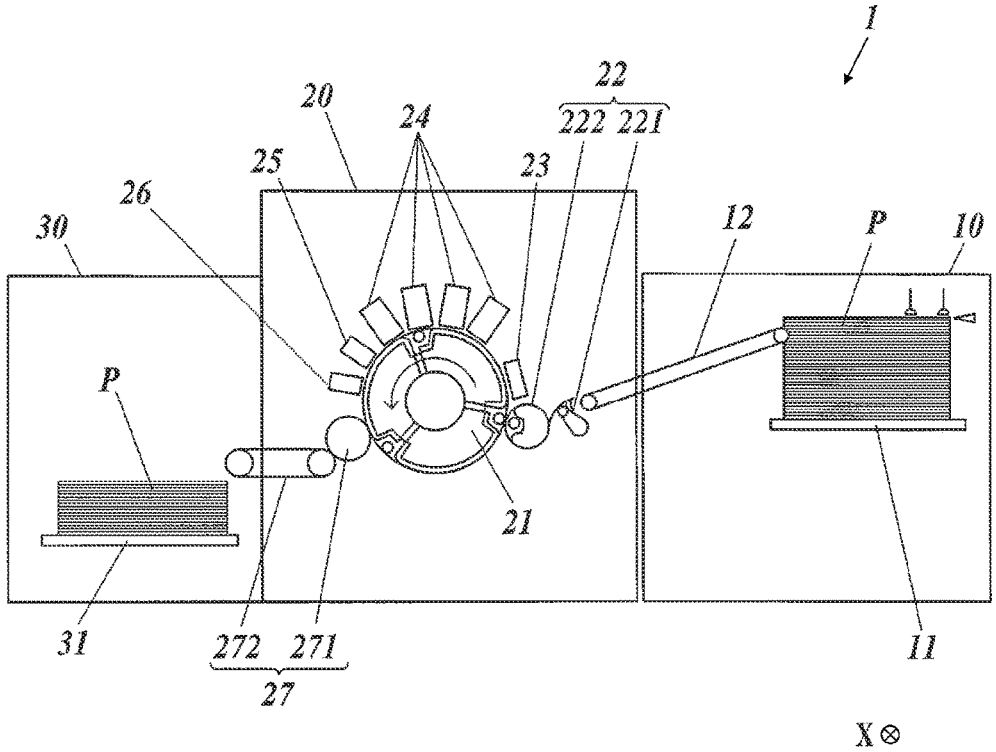
FIG. 1 schematically shows configuration of an inkjet recording device that is an embodiment(s) of the invention.

FIG. 1 schematically shows configuration of an inkjet recording device 1 that is an embodiment(s) of the invention.

Figure 3:
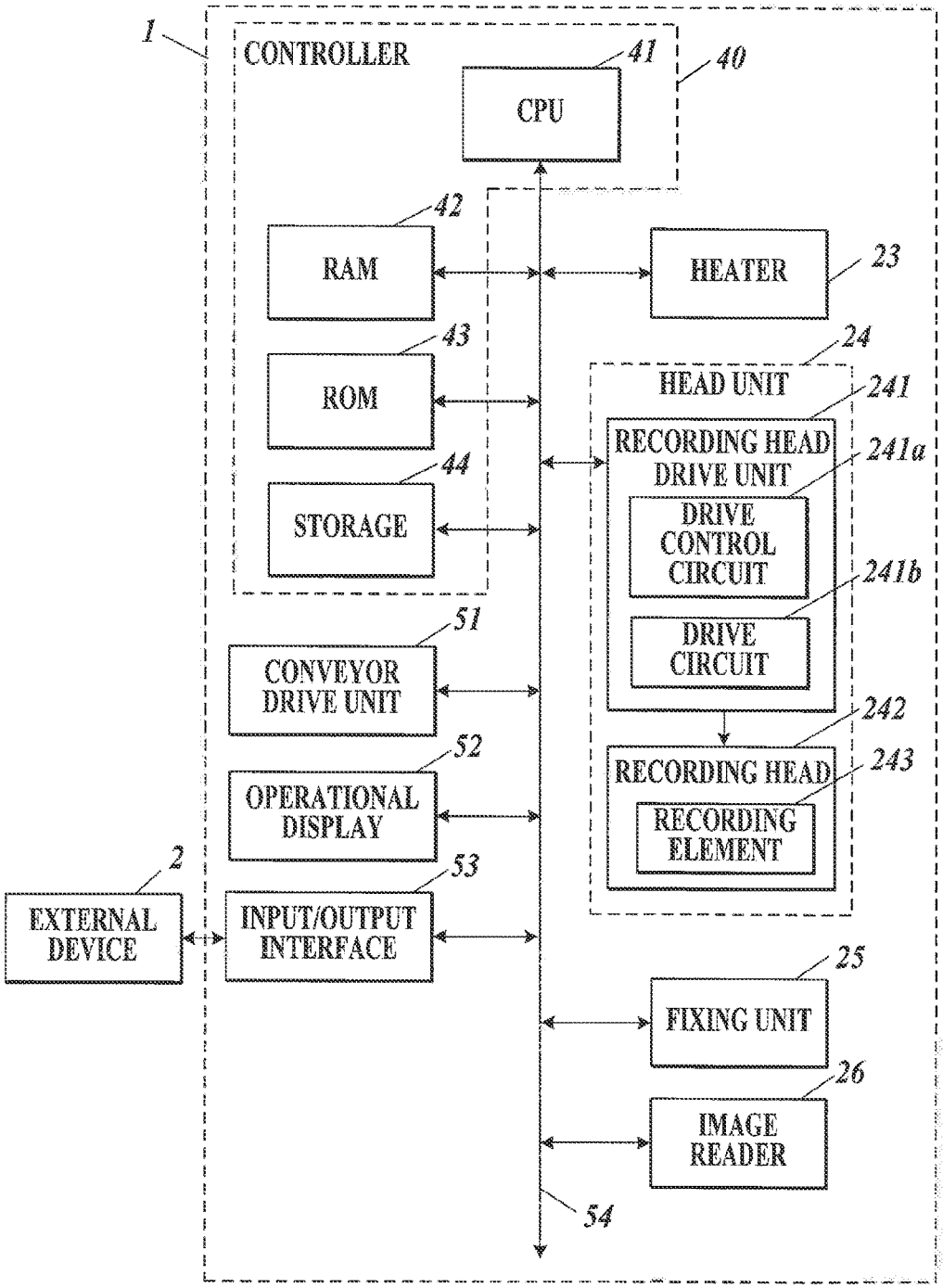
FIG. 3 is a block diagram showing main functional components of the inkjet recording device.

The inkjet recording device 1 includes a sheet feeder 10, an image recorder 20, a sheet receiver 30 and a controller 40 (FIG. 3). Under the control of the controller 40, the inkjet recording device 1 conveys recording media P stored in the sheet feeder 10 to the image recorder 20, records images on the recording media P with the image recorder 20, and conveys the recording media P with the images recorded to the sheet receiver 30.

As the recording media P, a variety of media can be used as long as ink discharged onto the surface thereof can be solidified there. Examples thereof include fabrics and sheet-shaped resins in addition to paper exemplified by plain paper and coated paper.

The sheet feeder 10 includes: a sheet feeding tray 11 where the recording media P are stored; and a media supply unit 12 that conveys and supplies the recording media P from the sheet feeding tray 11 to the image recorder 20. The media supply unit 12 includes a ring-shaped belt the inner side of which is supported by two rollers. The media supply unit 12 conveys the recording media P by rotating the rollers in the state in which the recording media P are placed on the belt.

The image recorder 20 includes a conveyor drum 21 (mover), a first delivery unit 22, a heater 23, head units 24 (recorders), a fixing unit 25, an image reader 26 (reader), and a second delivery unit 27.

The conveyor drum 21 conveys the recording media P in the conveying direction (Y direction) (moving direction), which is along its conveyor surface, by rotating on a rotation axis that extends in a direction perpendicular to FIG. 1 (X direction) (width direction) in the state in which the recording media P are held on the conveyor surface, which is a cylindrical outer circumferential surface. The conveyor drum 21 has not-shown claw parts and a not-shown suction device to hold the recording media P on the conveyor surface. The recording media P are held on the conveyor surface by the edges of the recording media P being held down with the claw parts and by the recording media P being attracted to the conveyor surface with the suction device.

The conveyor drum 21 is connected to a not-shown conveyor drum motor that rotates the conveyor drum 21, and rotates an angle proportional to the amount of rotation of the conveyor drum motor.

The first delivery unit 22 delivers, to the conveyor drum 21, the recording media P received from the media supply unit 12 of the sheet feeder 10. The first delivery unit 22 is disposed between the media supply unit 12 of the sheet feeder 10 and the conveyor drum 21, and holds and takes up, with a swing arm part 221, one end of each of the recording media P received from the media supply unit 12, and delivers, with a delivery drum 222, the recording media P to the conveyor drum 21.

The heater 23 is disposed between the arrangement position of the delivery drum 222 and the arrangement positions of the head units 24, and heats the recording media P conveyed by the conveyor drum 21 such that the recording media P have a temperature in a predetermined temperature range. The heater 23 has, for example, an infrared heater and so forth, and causes the infrared heater to generate heat by electrifying the infrared heater on the basis of control signals supplied from a CPU 41 (FIG. 3).

The head units 24 discharge, on the basis of image data, inks to the recording media P at appropriate timings according to the rotation of the conveyor drum 21 holding the recording media P, thereby generating images. The head units 24 are disposed such that their ink discharge surfaces face the conveyor drum 21 having a predetermined distance therebetween. In the inkjet recording device 1 of this embodiment, four head units 24 for four colors of yellow (Y), magenta (M), cyan (C) and black (K) are arranged at predetermined intervals to line up in the order of Y, M, C and K from the upstream side in the conveying direction of the recording media P.

Figure 2:
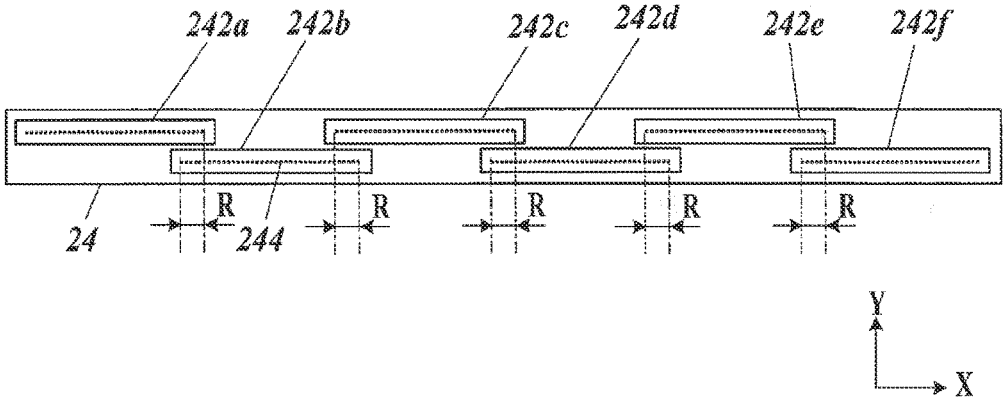
FIG. 2 is a schematic diagram showing configuration of a head unit.

FIG. 2 is a schematic view showing configuration of one of the head units 24. In this figure, in a plan view of the head unit 24 viewed from the side that faces the conveyor surface of the conveyor drum 21, positions of nozzles 244 of recording heads 242 are schematically shown.

The head unit 24 includes six recording heads 242*a* to 242*f* (when any of these is indicated, it/they may be expressed as a recording head(s) 242) in each of which the nozzles 244 of recording elements 243 (FIG. 3) are arranged in a direction that intersects the conveying direction of the recording media P (in this embodiment, a direction orthogonal to the conveying direction, i.e. X direction).

The six recording heads 242 included in the head unit 24 are arranged in a houndstooth check pattern such that their arrangement regions overlap in the X direction, and the nozzles 244 of the recording heads 242*a*, 242*c* and 242*e* that are arranged the odd number$^{th}$ along the X direction are located on one straight line, and the nozzles 244 of the recording heads 242*b*, 242*d* and 242*f* that are arranged the even number$^{th}$ along the X direction are located on one straight line. The six recording heads 242 are arranged in such a way as to be shifted from one another in the X direction in a positional relationship in which the arrangement region of, among the nozzles 244 (nozzle group), which are disposed in each recording heads 242, nozzles near one end of a recording head 242 in the X direction and the arrangement region of, among the nozzles 244 (nozzle group), which are disposed in each recording heads 242, nozzles near the other end of another recording head 242 in the X direction coincide with one another. In other words, the six recording heads 242 are arranged in a positional relationship in which the arrangement regions of the nozzle groups of the recording heads 242 in the X direction include regions that are different from one another, and ink dischargeable regions are connected to one another to be continuous in the X direction. In each region where the nozzle groups of recording heads 242 that form a pair are arranged to overlap in the X direction, an overlapping region R (joint) is set. In each overlapping region R, ink is discharged from nozzles of the recording heads 242 forming a pair in a complementary manner, the nozzles being disposed in the overlapping region R. In this embodiment, the whole region in the X direction where overlapping nozzles of the nozzle groups of the recording heads 242 forming a pair are arranged is regarded as the overlapping region R.

The arrangement region of the nozzles 244 included in each head unit 24 in the X direction covers the width in the X direction of the image formable region of the recording media P, which are conveyed by the conveyor drum 21. At the time of recording images, the head units 24 are used with their positions fixed with respect to the conveyor drum 21. That is, the inkjet recording device 1 is an inkjet recording device 1 employing a single-pass system.

Each recording head 242 may have two or more rows of nozzles 244. For example, each recording head 242 may have two rows of nozzles 244 arranged in the X direction, and the nozzles 244 of these two rows may be arranged in such a way as to be shifted in the X direction by ½ arrangement interval of the nozzles 244. The number of recording heads 242 that each head unit 24 has may be three or less, or five or more.

Each head unit 24 includes a recording head drive unit 241 (FIG. 3) that drives the recording heads 242. The recording head drive unit 241 has: a drive circuit 241*b* (drive unit) that supplies, to the recording heads 242, drive waveform voltage signals corresponding to pixel values of image data; and a drive control circuit 241*a* (drive controller) that supplies control signals containing the image data to the drive circuit 241*b* at appropriate timings.

Each recording element 243 included in each recording head 242 includes: a pressure chamber where ink is stored; a piezoelectric element disposed on the wall surface of the pressure chamber; and a nozzle 244. The drive circuit 241*b* of the recording head drive unit 241 outputs, according to pixel values of image data, drive waveform voltage signals to operate and transform the piezoelectric elements, and the recording elements 243 are configured such that the voltage signals are applied to the piezoelectric elements. When the drive waveform voltage signals are applied to the piezoelectric elements, in response to the voltage signals, the pressure chambers transform and the pressures in the pressure chambers change, and the nozzles that communicate with the pressure chambers discharge ink, which is called the ink discharge operation. As a result, ink is discharged from the nozzles 244 at amounts corresponding to pixel values of image data.

The amount(s) of ink to be discharged from the nozzle(s) 244 can be adjusted by correcting magnitude of voltage amplitude and/or voltage applying duration of the drive waveform voltage signal(s). Of these, the magnitude of the voltage signal can be corrected by changing power supply voltage input to the drive circuit 241*b*, for example. The magnitude of the voltage signal may be corrected by inputting different power supply voltages to the drive circuit 241*b* and selecting the magnitude of the voltage signal to be output from the drive circuit 241*b* from the different power supply voltages. Further, the voltage applying duration of the voltage signal can be corrected by changing drive waveform pattern data that is referred to when the drive waveform is output from the drive circuit 241*b*.

Although it is desired that the amounts of ink to be discharged from the nozzles 244 of the recording heads 242 in response to the same drive waveform voltage signal (i.e. voltage signals having the same drive waveform) are the same, there may be variation in the amount in each recording head 242 or among the recording heads 242 due to variation in temperature in the recording head(s) 244, variation in characteristics of the recording elements 243, and so forth.

In this embodiment, this variation in the amount of ink to be discharged is adjusted by correcting, for each head unit 242, the magnitude of the voltage of the drive waveform voltage signal. The adjustment method of this ink discharge amount(s) is detailed later.

As the ink(s) that is discharged from the nozzles of the recording elements, an ink that changes between the gel phase and the sol phase according to temperature and is cured by being irradiated with energy rays, such as ultraviolet rays, is used, for example.

In this embodiment, an ink that is a gel at room temperature and solates by heat is used. Each head unit 24 includes a not-shown ink heater that heats the ink stored in the head unit 24. This ink heater operates under the control of the CPU 41 (FIG. 3), and heats the ink to a temperature at which the ink solates. The recording heads 242 discharge the ink made to solate by being heated. When this sol ink is discharged to the recording media P, after the ink droplets land on the recording media P, they quickly gelatinize and solidify on the recording media P by being naturally cooled.

The fixing unit 25 has light emitters that are arranged in such a way as to cover the width in the X direction of the conveyor drum 21, and cures and fixes the inks on the recording media P, the inks having been discharged onto the recording media P, by emitting energy rays, such as ultraviolet rays, from the light emitters to the recording media P placed on the conveyor drum 21. The light emitters of the fixing unit 25 are arranged to face the conveyor drum 21 on the downstream side in the conveying direction of the arrangement positions of the head units 24 in the conveying direction.

The image reader 26 is disposed to face the conveyor drum 21 at a position on the downstream side of the ink fixing position of the fixing unit 25 in the conveying direction, and reads, with a predetermined reading range, images formed on the recording media P conveyed by the conveyor drum 21, and outputs imaging data of the images.

In this embodiment, the image reader 26 includes a light source that emits light to the recording media P conveyed by the conveyor drum 21 and a line sensor in which imaging elements that detect intensity of reflected light of incident light on the recording media P are arranged in the X direction. This line sensor can obtain images by waveform component, for example, by each of three waveforms of R (red), G (green) and B (blue). The configuration of the image reader 26 is not limited to the above, and hence an area sensor may be used instead of the line sensor.

The second delivery unit 27 has a looped belt 272 having a ring-shaped belt the inner side of which is supported by two rollers, and a columnar delivery drum 271 that delivers the recording media P from the conveyor drum 21 to the looped belt 272. The second delivery unit 27 conveys and ejects, with the looped belt 272, the recording media P delivered by the delivery drum 271 from the conveyor drum 21 onto the looped belt 272 to the sheet receiver 30.

The sheet receiver 30 has a plate-shaped sheet receiving tray 31 where the recording media P ejected from the image recorder 20 by the second delivery unit 27 are placed.

FIG. 3 is a block diagram showing main functional components of the inkjet recording device 1.

The inkjet recording device 1 includes: the controller 40 having the CPU 41 (Central Processing Unit) (setting section, recording control section, relationship information obtaining section, ink discharge amount information obtaining section), a RAM 42 (Random Access Memory), a ROM 43 (Read Only Memory) and a storage 44; the heater 23; for each head unit 24, the recording head drive unit 241 that drives the recording heads 242 of the head unit 24; the fixing unit 25; the image reader 26; a conveyor drive unit 51; an operational display 52; an input/output interface 53; and a bus 54.

The CPU 41 reads programs for various types of control and setting data stored in the ROM 43, stores the read ones in the RAM 42, and executes the programs and thereby performs various types of arithmetic processing. Thus, the CPU 41 controls the overall operations of the inkjet recording device 1. For example, the CPU 41 causes the components of the image recorder 20 to operate so as to record images on the recording media P on the basis of image data stored in the storage 44.

The RAM 42 provides a memory space for work for the CPU 41 and temporarily stores data therein. The RAM 42 may contain a nonvolatile memory.

The ROM 43 stores therein the programs for various types of control to be executed by the CPU 41, the setting data and so forth. The setting data includes test image data that is image data of a test image 60 which is used in the below-described ink discharge amount adjustment process. Instead of the ROM 43, a rewritable nonvolatile memory, such as an EEPROM (Electrically Erasable Programmable Read Only Memory) or a flash memory, may be used.

The storage 44 stores therein print jobs (image recording commands) and image data relevant to the print jobs input from an external device 2 via the input/output interface 53, and imaging data obtained by the image reader 26. The storage 44 also stores therein ink discharge amount data (ink discharge amount information) on the amount(s) of ink to be discharged from the nozzle groups of the recording heads 242, data on an approximate formula showing a relationship between ink discharge amount(s) and voltage correction value(s), and voltage correction values (set values) set for the respective recording heads 242 that are used in correcting drive waveform voltage signal(s). As the storage 44, for example, an HDD (Hard Disk Drive) is used, or a DRAM (Dynamic Random Access Memory) or the like may be used together.

The recording head drive unit 241 causes the recording heads 242 to discharge ink on the basis of control signals and image data supplied from the CPU 41. More specifically, when the CPU 41 supplies a control signal(s) containing image data to the recording head drive unit 241, the drive control circuit 241*a* of the recording head drive unit 241 causes the drive circuit 241*b* thereof to output a drive waveform voltage signal(s) having any of multiple drive waveform patterns corresponding to the pixel value(s) of the image data to the piezoelectric elements of the recording elements 243 of the recording heads 242. In response to this voltage signal, the recording heads 242 perform (i) discharge operation of discharging the amount of ink corresponding to the pixel value of the image data from the nozzles 244 of the recording elements 243 or (ii) no-discharge operation of discharging no ink (ii-a) if the pixel value of the image data is for no ink discharge or (ii-b) after an image recording operation finishes but before the next image recording operation starts.

In this embodiment, the drive control circuit 241*a* of the recording head drive unit 241 supplies the voltage signals having voltage values corrected according to the voltage correction values stored in the storage 44 from the drive circuit 241*b* to the recording heads 242.

The conveyor drive unit 51 supplies drive signals to the conveyor drum motor for the conveyor drum 21 on the basis of control signals supplied from the CPU 41 so as to rotate the conveyor drum 21 at a predetermined speed and predetermined timings. The conveyor drive unit 51 also supplies, on the basis of control signals supplied from the CPU 41, drive signals to motors that cause the media supply unit 12, the first delivery unit 22 and the second delivery unit 27 to operate so that the recording media P are fed to the conveyor drum 21 and ejected from the conveyor drum 21.

The operational display 52 includes: a display, such as a liquid crystal display or an organic EL display; and an inputter, such as operation keys or a touchscreen disposed on the screen of the display. The operational display 52 displays a variety of pieces of information on the display, and converts input operations of a user(s) on the inputter into operation signals and outputs the operation signals to the controller 40.

The input/output interface 53 is to send/receive data to/from the external device 2, and is constituted of, for example, one of or a combination of a variety of serial interfaces and a variety of parallel interfaces.

The bus 54 is a channel to send/receive signals to/from the controller 40 from/to the other components.

The external device 2 is, for example, a personal computer, and supplies the print jobs, the image data and so forth to the controller 40 via the input/output interface 53.

Next, ink-discharge amount adjustment operations to adjust the amount of ink to be discharged from the nozzle groups of the recording heads 242 of the head unit(s) 24 are described.

In the inkjet recording device 1, in order to record images having a certain quality or higher, it is required that variation in the amount(s) of ink to be discharged (ink discharge amounts) from the nozzle groups of the recording heads 242 according to image data having a predetermined density is in a predetermined reference range.

Further, it is required that difference between representative values of ink discharge amounts at each joint in the nozzle groups of the recording heads 242 satisfies a predetermined continuity condition.

Hence, in the ink discharge amount adjustment operations of the inkjet recording device 1 of this embodiment, in order to suppress variation in the ink discharge amount among the recording heads and separation of ink discharge amounts at each joint in the nozzle groups, voltage correction values for drive waveform voltage signals to be supplied to the recording heads 242 are set for the respective recording heads 242. In the ink discharge amount adjustment operations, from reading results of a predetermined test image recorded by the head unit 24, the ink discharge amount data on distribution in the X direction of the ink discharge amounts to be discharged from the nozzle groups of the recording heads 242 according to image data having a predetermined density is obtained, and voltage connection values are set for the respective recording heads 242 on the basis of the ink discharge amount data in such a way as to suppress the density variation and density unevenness.

Figure 4:
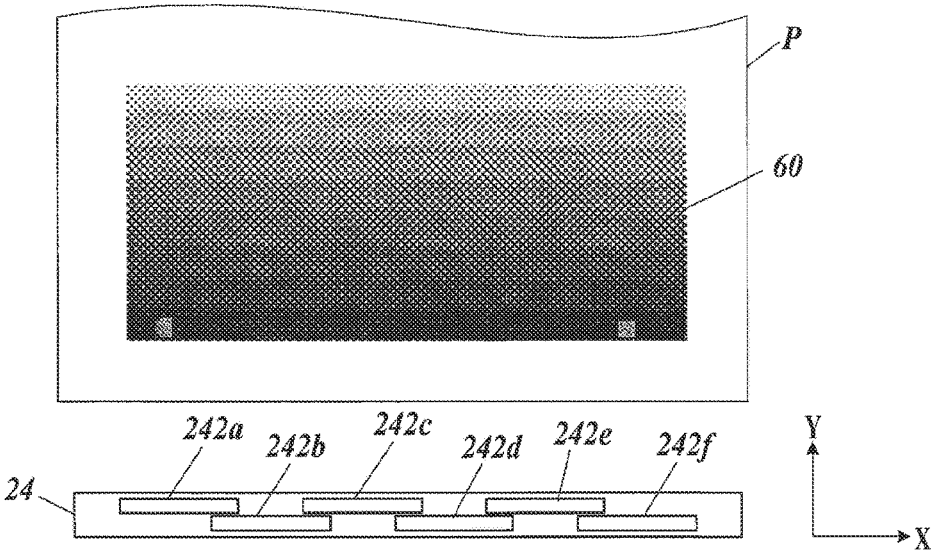
FIG. 4 shows an example of a test image that is used in ink discharge amount adjustment operations.

FIG. 4 shows an example of a test image 60 that is used in the ink discharge amount adjustment operations.

The test image 60 is a gradation pattern recorded by the six recording heads 242*a* to 242*f* of the head unit 24. This test image 60 is an image formed by increasing the amount of ink to be discharged from the nozzle groups of the recording heads 242*a* to 242*f* stepwise while conveying a recording medium P.

From reading results of the gradation pattern of the test image 60 by the image reader 26, the ink discharge amount of the nozzle group of each recording head 242 and its corresponding read density are obtained. From distribution in the X direction of the read densities, the distribution in the X direction of the ink discharge amounts can be obtained. Here, the read density can be, among the reading results of the gradation pattern of the test image 60, for example, the reading result of the density of a particular gradation at which density variation is significantly visible. The read density may be the average value of the reading results of the densities of the respective gradations in the gradation pattern of the test image 60 or the sum (or the average value) of the values obtained by performing predetermined weighting on the reading results of the densities of the respective gradations. In this embodiment, the ink discharge amount data in which positions of the nozzle groups in the X direction are correlated with the ink discharge amounts corresponding to the read densities is generated and stored in the storage 44.

Although FIG. 4 shows only the test image 60 recorded by one head unit 24, test images 60 may be recorded by the four head units 24 on one recording medium P.

Figure 5:
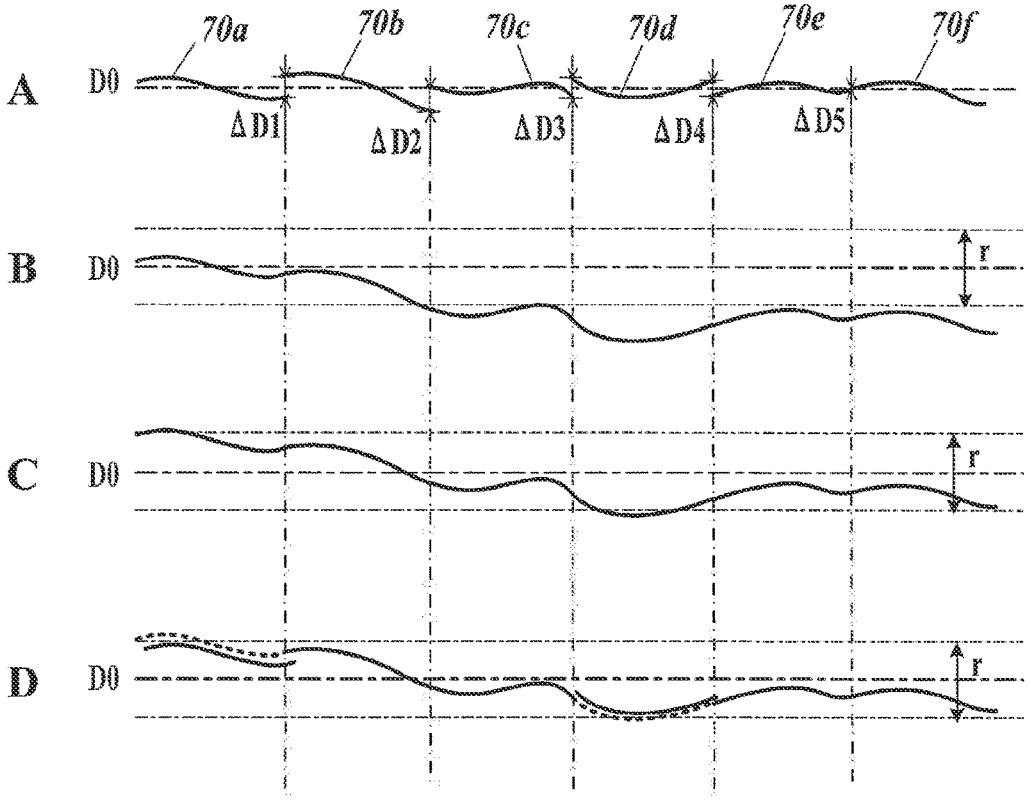
FIG. 5 is a diagram to explain the ink discharge amount adjustment operations.

FIG. 5 is a diagram to explain the ink discharge amount adjustment operations of this embodiment. The A to D in FIG. 5 show predictive values of ink discharge amounts 70*a* to 70*f* of the nozzle groups of the recording heads 242*a* to 242*f* in the case where the test image 60 is recorded on the basis of setting of voltage correction values at respective steps of the ink discharge amount adjustment operations. Hereinafter, the ink discharge amount of the nozzle group of each recording head 242 is simply referred to as the ink discharge amount of the recording head 242.

In the ink discharge amount adjustment operations of this embodiment, first, on the basis of the ink discharge amount data stored in the storage 44, the average values of the respective ink discharge amounts 70*a* to 70*f* of the recording heads 242 are obtained, and on the basis of differences between the respective average values and a predetermined ink discharge amount reference value D0, voltage correction values for drive waveform voltage signals for the respective recording heads 242 are set such that the respective average values of the ink discharge amounts 70*a* to 70*f* of the recording heads 242 match the reference value D0. The A in FIG. 5 shows predictive values of the ink discharge amounts in the case where the test image 60 is recorded by the head unit 24 on the basis of thus-set voltage correction values.

The ink discharge amount reference value D0 is a value at the center of an ink discharge amount reference range r for the density of the test image 60 used in generating the ink discharge amount data. The reference range r is the ink discharge amount range of the ink discharge amount in which images having the density of the test image 60 can be recorded at a proper quality. The upper limit value and the lower limit value of the reference range r are determined as described below.

That is, the ink discharge amount being too much causes insufficient ink curing because light from the light emitters of the fixing unit 25 is absorbed near the surface of ink droplets discharged onto the recording media P and accordingly does not reach the inside of the ink droplets. Hence, the upper limit value of the reference range r is determined in the range of the ink discharge amount in which ink can be properly cured, and a possible larger value is preferable in order to make adjustment of the ink discharge amount(s) easy.

Meanwhile, the ink discharge amount being too little does not allow appropriate supplementing which increases the ink discharge amounts of nozzles around defective nozzles, which are poor in ink discharge, to supplement no ink discharge from the defective nozzles. Hence, the lower limit value of the reference range r is determined in the range of the ink discharge amount in which no ink discharge from detective nozzles can be properly supplemented, and a possible smaller value is preferable in order to make adjustment of the ink discharge amount(s) easy.

The voltage correction values are set on the basis of the following algorithm using an approximate formula showing a relationship between the ink discharge amount and the voltage correction value.

Figure 6:
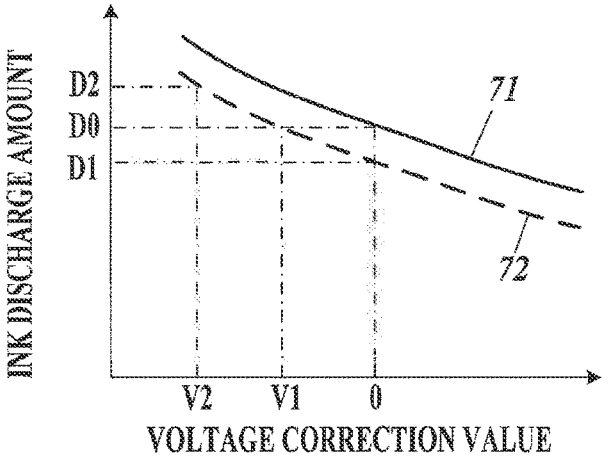
FIG. 6 shows a relationship between voltage correction value and ink discharge amount, the relationship being used in setting voltage correction values.

FIG. 6 shows the relationship between the voltage correction value and the ink discharge amount, the relationship being used in setting the voltage correction values.

A curve 71 indicated by a solid line in FIG. 6 shows a relationship between the voltage correction value and the ink discharge amount at a part(s) of the nozzle groups of the recording heads 242*a* to 242*f* where the ink discharge amount becomes the reference value D0 if the voltage correction value is 0. This curve 71 is obtained as follow: the head unit 24 records, in advance, test images 60 using different voltage correction values, and ink discharge amounts at predetermined points on the recorded test images 60 in the X direction are plotted with respect to the used voltage correction values. The storage 44 of the controller 40 stores therein data showing the approximate formula (mathematical relation) of the curve 71 indicated by the solid line. Instead of the above approximate formula, table data showing the relationship between the voltage correction value and the ink discharge amount may be stored in the storage 44, and the voltage correction values may be set with reference to the table data.

The recoding of the text images 60, the derivation of the approximate formula, and the generation of the table data can be performed under the control of the controller 40. The derivation of the approximate formula and the generation of the table data may be performed by the external device 2.

A curve 72 indicated by a broken line in FIG. 6 is a curve translated in the direction of the vertical axis representing the ink discharge amount, and indicates a relationship between the voltage correction value and the average value of the ink discharge amount(s) at a particular part of the nozzle groups of the recording heads 242*a* to 242*f*. This particular part may be, for example, a part of the nozzle groups (a joint(s) in the nozzle groups, etc.), the whole nozzle group of one recording head 242 or all the nozzle groups of all the recording heads 242. Thus, the relationship between the ink discharge amount and the voltage correction value at any part of the head unit 24 is expressed by a curve to which the curve 71 is translated in the vertical axis direction.

The curve 72 in FIG. 6 indicates an example of the case where the average value of the ink discharge amount(s) when ink is discharged with a voltage correction value of 0 is D1. The coordinate on the horizontal axis of, among points on this curve 72, a point the coordinate on the vertical axis of which matches a target value of the ink discharge amount after adjustment is the voltage correction value for the ink discharge amount after adjustment. For example, in order to adjust the ink discharge amount such that the average value of the ink discharge amount(s) at the particular part of the nozzle groups having characteristics indicated by the curve 72 becomes the reference value D0, a voltage correction value V1 for a point on the curve 72 where the ink discharge amount is the reference value D0 is obtained and set as the voltage correction value for the recording head(s) 242.

In the state in which the voltage correction values are set such that predictive values of the ink discharge amounts form the distribution shown in A in FIG. 5, although the average value of each of the ink discharge amounts 70*a* to 70*f* of the recording heads 242 matches the reference value D0, differences are generated between the ink discharge amounts at respective joints in the nozzle groups. That is, at the joint in the nozzle groups of the recording heads 242*a* and 242*b*, the representative value of the ink discharge amount 70*a* at the joint is separate from the representative value of the ink discharge amount 70*b* at the joint by ΔD1. Following that, at the joints in the nozzle groups of the recording heads 242 arranged in the X direction in order, the representative values of the ink discharge amounts are separate from one another by ΔD2 to ΔD5, respectively. Here, the representative value may be, for example, the average value or the median value of the ink discharge amount at a joint. If the magnitude of separation (difference) of these values exceeds the upper limit of the range in which no density unevenness is visible, density unevenness is visible at a part(s) on recorded images, the part(s) corresponding to the joint(s) in the nozzle groups. Hence, the voltage correction values for the recording heads 242*b* to 242*f* are changed and set on the basis of the above algorithm such that the differences (ΔD1 to ΔD5) between the representative values of the ink discharge amounts of the nozzle groups at the respective joints in the nozzle groups become 0. For example, in the recording head(s) 242 having characteristics indicated by the curve 72 in FIG. 6, if the average value of the ink discharge amount of the whole nozzle group is adjusted to D2 in order to make the difference between the representative values of the ink discharge amounts at a joint(s) 0, a voltage correction value V2 for a point on the curve 72 where the ink discharge amount is D2 is obtained and set as the voltage correction value for the recording head(s) 242.

Instead of the above, the voltage correction values may be set such that the differences between the representative values of the ink discharge amounts of the nozzle groups at the joints in the nozzle groups each satisfy the predetermined continuity condition. The predetermined continuity condition may be, for example, that the difference between the representative values of the ink discharge amounts of the nozzle groups at a joint therein is equal to or smaller than a predetermined reference difference. The predetermined reference difference is determined, for example, in the range in which density unevenness is invisible or unnoticeable at a part(s) on recorded images, the part(s) corresponding to the joint(s), and a larger value is preferable in order to make setting of the voltage correction values for the recording heads 242 easy.

The B in FIG. 5 shows predictive values of the ink discharge amounts 70*a* to 70*f* in the case where the test image 60 is recorded by the head unit 24 on the basis of thus-set voltage correction values.

Although the ink discharge amounts at the joints in the nozzle groups are continuous in B in FIG. 5, the ink discharge amounts made to be thus continuous accumulate the differences between the ink discharge amounts at both ends of the respective nozzle groups of the recording heads 242 in the X direction, and accordingly the ink discharge amounts of some of the recording heads 242 greatly depart from the reference value D0 and are outside the reference range r. That is, in the case shown in B in FIG. 5, at least a portion of the ink discharge amount of each of the recording heads 242*b* to 242*f* takes a value outside the reference range r. Hence, in order to put a larger portion of the ink discharge amounts of the nozzle groups of the recording heads 242*a* to 242*f* in the reference range r, the voltage correction values for the recording heads 242*a* to 242*f* are changed and set such that the average value (representative value) of the ink discharge amounts 70*a* to 70*f* of the recording heads 242*a* to 242*f* matches the reference value D0.

The C in FIG. 5 shows predictive values of the ink discharge amounts 70*a* to 70*f* in the case where the test image 60 is recorded by the head unit 24 on the basis of thus-set voltage correction values.

The ink discharge amount adjustment operations corresponding to A to C in FIG. 5 correspond to a first adjustment operation.

When the first adjustment operation finishes, it could happen that at least a portion of the ink discharge amount of any of the recording heads 242 takes a value outside the reference range r. For example, in C in FIG. 5, portions of the ink discharge amounts 70*a* and 70*d* of the recording heads 242*a* and 242*d* take values outside the reference range r. Hence, in this embodiment, after the first adjustment operation, a second adjustment operation is performed, and in the second adjustment operation, the voltage correction values for the recording heads 242*a* and 242*d* are changed and set such that the ink discharge amounts 70*a* and 70*d* of the recording heads 242*a* and 242*d* become values in the reference range r.

The D in FIG. 5 shows predictive values of the ink discharge amounts 70*a* to 70*f* in the case where the test image 60 is recorded by the head unit 24 on the basis of thus-set voltage correction values.

This suppresses density unevenness that appears at the joints in the nozzle groups, and also puts the ink discharge amounts 70*a* to 70*f* of the recording heads 242*a* to 242*f* in the reference range r and accordingly suppresses density variation on recorded images, which is caused by variation in the ink discharge amount among the recording heads.

In the above, the first adjustment operation and the second adjustment operation are performed on the basis of the ink discharge amount data by taking the ink discharge amounts, into which the read densities have been converted, as indicators. Instead, the first and second adjustment operations may be performed with ink discharge amount data containing distribution in the X direction of read densities of a test image in the X direction by taking the read densities as indicators. In this case, instead of the ink discharge amount reference value D0, a density reference value corresponding to the reference value D0 is used, and instead of the ink discharge amount reference range r, a density reference range corresponding to the reference range r is used. In addition, instead of the curves 71 and 72 shown in FIG. 6, curves indicating a mathematical relation showing a relationship between the voltage correction value and the read density are used.

Next, control procedure that is taken by the CPU 41 in the ink discharge amount adjustment process that is performed by the inkjet recording device 1 is described.

Figure 7:
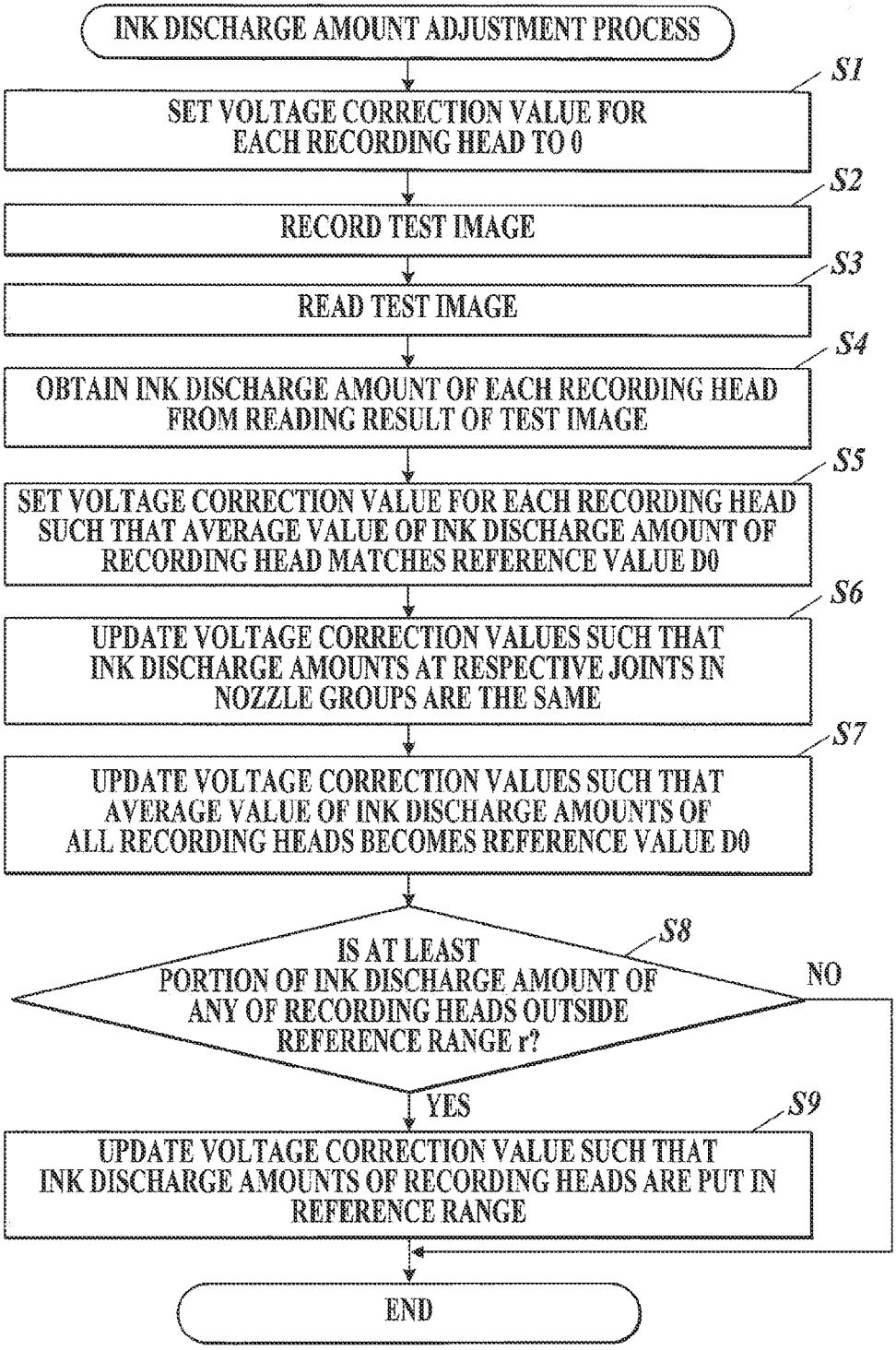
FIG. 7 is a flowchart showing control procedure in an ink discharge amount adjustment process.

FIG. 7 is a flowchart showing the control procedure in the ink discharge amount adjustment process.

This ink discharge amount adjustment process is performed, for example, when a user performs, on the operational display 52, an input operation for a command to adjust ink discharge amounts. This ink discharge amount adjustment is performed, for example, when some or all of the recording heads 242 of the head unit 24 are replaced.

When the ink discharge amount adjustment process is started, the CPU 41 sets a voltage correction value for each recording head 242 to 0 and stores the same in the storage 44 (Step S1).

The CPU 41 causes the head unit 24 to record the test image 60 shown in FIG. 4 on one recording medium P (Step S2). That is, the CPU 41 outputs a control signal to the conveyor drive unit 51 so as to rotate the conveyor drum 21 to convey the recording medium P. Then, the CPU 41 supplies a control signal containing test image data stored in the ROM 43 to the recording head drive unit 241 to cause the recording head drive unit 241 to output drive waveform voltage signals to the recording heads 242 at appropriate timings according to the rotation of the conveyor drum 21, thereby causing the head unit 24 to discharge ink from the nozzles 244 onto the recording medium P conveyed by the conveyor drum 21 to form the test image 60 thereon.

The CPU 41 causes the image reader 26 to repeatedly read the test image 60 formed on the recording medium P at proper intervals while causing the conveyor drum 21 to convey the recording medium P, and obtains imaging data and stores the same in the storage 44 (Step S3).

The CPU 41 obtains an ink discharge amount(s) of the nozzle group of each recording head 242 from the reading results (imaging data) of the test image 60, generates the ink discharge amount data and stores the same in the storage 44 (Step S4).

The CPU 41 sets the voltage correction value for each recording head 242 such that the average value of the ink discharge amount(s) of each recording head 242 matches the reference value D0 (Step S5: setting step). That is, the CPU 41 calculates the average value of the ink discharge amount of each recording head 242 on the basis of the ink discharge amount data, and sets, on the basis of the average value and the approximate formula showing the relationship between the ink discharge amount and the voltage correction value, the voltage correction value for each recording head 242 such that the average value of the ink discharge amount of each recording head 242 matches the reference value D0, and stores the same in the storage 44.

If it is known in advance that there is no variation in the ink discharge amount of the nozzle group of each recording head 242, and the ink discharge amounts at the both ends of the respective nozzle groups in the X direction match, when the process in Step S5 finishes, the ink discharge amount adjustment process may be ended. Further, if it is known in advance that there is variation in the ink discharge amount of each nozzle group, and the ink discharge amounts at the both ends of the respective nozzle groups in the X direction do not match, the process in Step S5 may be omitted.

The CPU 41 updates the voltage correction values for the respective recording heads 242 such that the differences between the representative values of the ink discharge amounts of the nozzle groups at the respective joints in the nozzle groups become 0 (Step S6: setting step, first adjustment operation). That is, the CPU 41 calculates (i) the ink discharge amounts at the both ends of the respective nozzle groups of the recording heads 242 in the case where ink is discharged on the basis of the voltage correction values set in Step S5 and (ii) the differences between the ink discharge amounts at the respective joints in the nozzle groups in this case, updates the voltage correction values for the respective recording heads 242 in order such that the differences become 0, and stores the same in the storage 44.

The CPU 41 updates the voltage correction values for the respective recording heads 242 such that the average value of all the ink discharge amounts of all the recording heads 242 becomes the reference value D0 (Step S7: setting step, first adjustment operation). That is, the CPU 41 calculates the average value of all the ink discharge amounts of all the recording heads 242 in the case where ink is discharged on the basis of the voltage correction values set in Step S6, and sets the voltage correction values for the respective recording heads 242 such that the average value matches the reference value D0, namely, such that the ink discharge amounts of the respective recording heads 242 are shifted by the amount equivalent to the difference between the average value and the reference value D0, and stores the same in the storage 44.

The CPU 41 determines whether at least a portion of the ink discharge amount of any of the recording heads 242 takes a value outside the reference range r if ink is discharged on the basis of the voltage correction values set in Step S7 (Step S8). When determining that all portions of the ink discharge amounts of all the recording heads 242 take values in the reference range r (Step S8: "NO"), the CPU 41 ends the ink discharge amount adjustment process.

When determining that at least a portion of the ink discharge amount of any of the recording heads 242 takes a value outside the reference range r (Step S8: "YES"), the CPU 41 changes the voltage correction value(s) such that the ink discharge amounts of the respective recording heads 242 are put in the reference range r (Step S9: setting step, second adjustment operation). That is, the CPU 41 changes the voltage correction value(s) for the recording head(s) 242 having the ink discharge amount(s), at least a portion of which takes a value outside the reference range r, such that the ink discharge amount(s) of the recording head(s) 244 is put in the reference range r, and stores the same in the storage 44.

When finishing the process in Step S10, the CPU 41 ends the ink discharge amount adjustment process.

After the ink discharge amount adjustment process, when a print job and image data relevant to the print job are stored in the storage 44, the CPU 41 causes the head unit(s) 24 to record an image of the image data relevant to the print job on the basis of the voltage correction values set by the ink discharge amount adjustment process. The process by the CPU 41 for recording the image is the same as the process in Step S1 of the ink discharge amount adjustment process except the content of the image data.

As described above, the inkjet recording device 1 of this embodiment includes the head unit(s) 24 that discharges an ink to a recording medium P from nozzles 244 disposed in each of recording heads 242; and the CPU 41, wherein the CPU 41 (setting section) performs, for the respective recording heads 242, setting relevant to adjustment of the amount of the ink to be discharged from nozzle groups each constituted of at least a part of the nozzles 244, which are disposed in each of the recording heads 242, the recording heads 242 are disposed such that the arrangement regions of the nozzle groups in the X direction, the nozzle groups corresponding to the respective recording heads 242, include regions different from one another, and ink dischargeable regions are connected to one another to be continuous in the X direction, and the CPU 41 as the setting section performs: the first adjustment operation, thereby, based on the ink discharge amount data on the distribution in the X direction of the ink discharge amounts that are discharged from the nozzle groups based on image data having a predetermined density, performing the setting for the respective recording heads 242 such that at each joint of joints in the nozzle groups in the X direction, the difference between the representative values of the ink discharge amounts satisfies the predetermined continuity condition, each joint being formed by a pair of the nozzle groups, and the representative value of the ink discharge amounts of all the nozzle groups matches the reference value D0; and after the first adjustment operation, the second adjustment operation, thereby adjusting at least a part of the setting, which has been performed for the respective recording heads 242, such that the difference between the maximum value and the minimum value of the ink discharge amounts of the nozzle groups reduces. The first adjustment operation suppresses density unevenness at the joints in the nozzle groups, and the second adjustment operation suppresses density variation on recorded image(s), which is caused by variation in the ink discharge amount among the recording heads. This can more effectively suppress decrease in quality of images to be recorded by the long head unit(s) 24 having the recording heads 242.

Further, the CPU 41 (setting section) takes, of the nozzle groups, a recording head 242 having the ink discharge amount departing from the predetermined reference range r as an adjustment target for which the setting is adjusted, and adjusts the setting for the recording head 242 as the adjustment target such that the ink discharge amount is in the predetermined reference range r. This can make variation in the ink discharge amount of each recording head 242 small, and hence can suppress density unevenness on recorded images, which is caused by variation in the ink discharge amount among the recording heads 242.

Further, the CPU 41 (setting section) performs the first adjustment operation and the second adjustment operation using a mathematical relation or table data showing a relationship between the voltage correction value relevant to an adjustment amount of the amount of the ink to be discharged and the magnitude of each of the ink discharge amounts. This can set voltage correction values that can properly adjust ink discharge amounts.

Further, the inkjet recording device 1 includes the image reader 26 that reads an image recorded on the recording medium P by the head unit 24, and the CPU 41 (relationship information obtaining section) causes the image reader 26 to read images having different densities and obtains the mathematical relation or the table data based on the result of the reading. This makes it possible for the inkjet recording device 1 to obtain the above mathematical relation or table data that is used in the ink discharge amount adjustment operations.

Further, the inkjet recording device 1 includes the image reader 26 that reads an image recorded on the recording medium P by the head unit 24, and the CPU 41 (ink discharge amount information obtaining section) obtains the ink discharge amount information from the result of reading of a test image by the image reader 26, the test image being recorded by the head unit 24 based on predetermined test image data. This makes it possible for the inkjet recording device 1 to obtain the ink discharge amount data that is used in the ink discharge amount adjustment operations.

Further, the inkjet recording device 1 includes: the drive circuit 241*b* that supplies, to the recording heads 242, a drive waveform voltage signal(s) that makes the ink to be discharged from each of the nozzles 244, which are disposed in each of the recording heads 242; and the drive control circuit 241*a* that controls the voltage signal which is supplied by the drive circuit 241*b* to the recording heads 242, wherein the CPU 41 (setting section) sets a voltage correction value(s) relevant to the magnitude of the voltage amplitude of the voltage signal by the drive control circuit 241*a*. This can adjust the ink discharge amounts by making ink to be discharged from the nozzles 244 on the basis of the set voltage correction values.

Further, the head unit 24 includes a line head in which the nozzle groups are disposed in the X direction to cover the recording width in the X direction to the recording medium P. This can record, at high speed, images with decease in quality suppressed.

Further, the inkjet recording device 1 includes the conveyor drum 21 that moves the head unit 24 and the recording medium P relative to one another, and the CPU 41 (recording control section) causes the head unit 24 to discharge the ink to the recording medium P from the nozzle groups based on image data, thereby recording an image on the recording medium P, the recording medium P performing the relative movement in the Y direction. This makes it possible for the inkjet recording device 1 that is compact to record, at high speed, images with decrease in quality suppressed.

Further, an ink-discharge adjustment method for an inkjet recording device(s) of this embodiment is the adjustment method for the inkjet recording device 1 including the head unit(s) 24 that discharges an ink to a recording medium P from nozzles disposed in each of recording heads 242, including: the setting step of performing, for the respective recording heads 242, setting relevant to adjustment of the amount of the ink to be discharged from nozzle groups each constituted of at least a part of the nozzles 244, which are disposed in each of the recording heads 242, wherein the recording heads 242 are disposed such that the arrangement regions of the nozzle groups in the X direction, the nozzle groups corresponding to the respective recording heads 242, include regions different from one another, and ink dischargeable regions are connected to one another to be continuous in the X direction, and the setting step includes: the first adjustment step of, based on the ink discharge amount data on the distribution in the X direction of the ink discharge amounts that are discharged from the nozzle groups based on image data having a predetermined density, performing the setting for the respective recording heads 242 such that at each joint of joints in the nozzle groups in the X direction, the difference between the representative values of the ink discharge amounts satisfies the predetermined continuity condition, each joint being formed by a pair of the nozzle groups, and the representative value of the ink discharge amounts of all the nozzle groups matches the reference value D0; and after the first adjustment step, the second adjustment step of adjusting at least a part of the setting, which has been performed for the respective recording heads 242, such that the difference between the maximum value and the minimum value of the ink discharge amounts of the nozzle groups reduces. This can more effectively suppress decrease in quality of images to be recorded by the long head unit(s) 24.

First Modification

Next, a first modification from the above embodiment is described. This first modification is different from the above embodiment in the second adjustment operation of the ink discharge amount adjustment operations. Hereinafter, the different points from the above embodiment are described.

Figure 8:
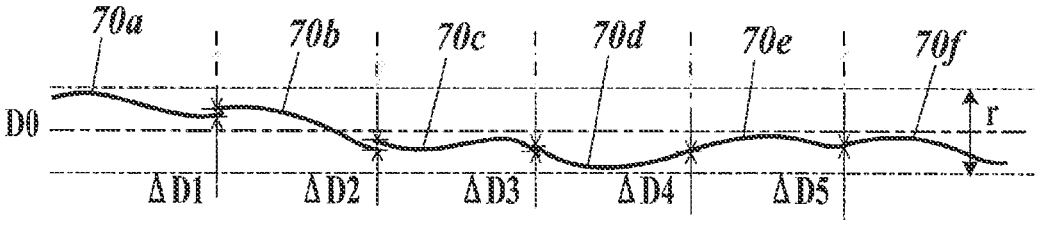
FIG. 8 is a diagram to explain a second adjustment operation of the ink discharge amount adjustment operations according to a first modification.

FIG. 8 is a diagram to explain the second adjustment operation of the ink discharge amount adjustment operations according to the first modification.

FIG. 8 shows a mode of the second adjustment operation after the voltage correction values are updated such that the ink discharge amounts of the recording heads 242 take values shown in C in FIG. 5. In the first modification, the voltage correction values for the recording heads 242*a* and 242*d* having the ink discharge amounts, portions of which take values outside the reference range r in C in FIG. 5, are changed such that the ink discharge amounts 70*a* and 70*d* are put in the reference range r, and also the voltage correction value(s) for at least one of the recording heads 242*b*, 242*c*, 242*e* and 242*f* is adjusted such that all the differences ΔD1 to ΔD5 between the representative values of the ink discharge amounts at the respective joints in the nozzle groups of the recording heads 242 satisfy the predetermined continuity condition. For example, in FIG. 8, the ink discharge amounts 70*a* and 70*d* are decreased and increased, respectively, in such a way as to be in the reference range r, and also the ink discharge amounts 70*b* and 70*c* and the ink discharge amounts 70*e* and 70*f* are decreased and increased, respectively, such that the differences ΔD1, ΔD3 and ΔD4 generated by decreasing the ink discharge amount 70*a* and increasing the ink discharge amount 70*d* become equal to or smaller than the predetermined reference difference.

The voltage correction values for the recording heads 242*b*, 242*c*, 242*e* and 242*f* may further be adjusted such that the sum of the differences ΔD1 to ΔD5 becomes the minimum.

Thus, in the inkjet recording device 1 of this first modification, in the second adjustment operation, the CPU 41 (setting section) adjusts the setting for, among the recording heads 242, a recording head 242 other than the recording head 242 as the adjustment target in the range in which at each joint of the joints in the nozzle groups, the difference between the representative values of the ink discharge amounts satisfies the predetermined continuity condition, each joint being formed by a pair of the nozzle groups. This can suppress variation in the ink discharge amount among the recording heads 242 and also make the difference between the ink discharge amounts at each joint in the nozzle groups small, and hence can more effectively suppress decrease in quality of recorded images.

Second Modification

Next, a second modification from the above embodiment is described. This second modification is different from the above embodiment in (i) the first and second adjustment operations being performed on the basis of read densities and (ii) the content of the second adjustment operation. Hereinafter, the different points from the above embodiment are described.

In the second modification, the first and second adjustment operations are performed with the ink discharge amount data containing the distribution in the X direction of the read densities of the test image 60 on the basis of the read densities. Of these adjustment operations, the second adjustment operation is performed on the basis of the following algorithm. That is, the set value(s) for at least one of the recording heads 242 is adjusted such that the difference between the maximum value and the minimum value of the read densities relevant to the recording heads 242*a* to 242*f* reduces, and also a value obtained by adding the sum of the differences between the respective average values of the read densities relevant to the respective recording heads 242 and the density reference value to the sum of the differences between the representative values of the read densities at the respective joints in the nozzle groups of the recording heads 242 becomes the minimum.

Thus, in the inkjet recording device 1 of this second modification, the CPU 41 (ink discharge amount information obtaining section) obtains, from the result of the reading of the test image 60 by the image reader 26, the ink discharge amount data containing the distribution of the read densities of the test image relevant to the nozzle groups, the distribution corresponding to the distribution of the ink discharge amounts, and the CPU 41 (setting section) performs, in the second adjustment operation, adjusts the setting for the recording heads 242 such that the added value of: the sum of the differences each between the average value of each of the read densities relevant to the respective nozzle groups and the reference value D0; and the sum of the differences between the representative values of the read densities at the respective joints in the nozzle groups, each of the joints being formed by a pair of the nozzle groups and the read densities being relevant to the respective nozzle groups, is the minimum. This can make both variation in the ink discharge amount among the recording heads 242 and differences between the ink discharge amounts at the respective joints in the nozzle groups small in a balanced manner, and hence can more effectively suppress decrease in quality of recorded images. Further, without converting the read densities into the ink discharge amounts, by taking the read densities themselves as indicators, the voltage correction values are set on the basis of the above algorithm. This can prevent the voltage correction values from shifting from the optimal values, which is caused by conversion error from the read densities into the ink discharge amounts, and hence can more effectively suppress decrease in quality of recorded images.

The invention is not limited to the above embodiment or modifications, and can be modified in a variety of aspects.

For example, in the above embodiment and modifications, the amounts of ink to be discharged from the nozzles 244 are adjusted by changing the magnitude(s) of the voltage amplitude(s) of the drive waveform voltage signals according to the voltage correction values as the set values. Instead, the voltage applying duration(s) of the voltage signals may be changed, or both the magnitude(s) of the voltage amplitude(s) and the voltage applying duration(s) of the voltage signals may be changed.

Further, in the above embodiment and modifications, each nozzle group is constituted of all the nozzles 244 of its recording head 244. Alternatively, each nozzle group may be constituted of all the nozzles 244 of its recording head 242 except some nozzles 244 near the ends in the X direction. That is, of all the nozzles 244 of the recording head 242, the nozzles near the ends of the recording head 242 may not be used in recording images.

Further, in the above embodiment and modifications, the arrangement regions of the nozzle groups of the recording heads 242 that form a pair overlap in the X direction, and the overlapping region R where the recording heads 242 forming a pair perform ink discharge in a complementary manner is equivalent to the joint in the nozzle groups, but this is not intended to limit the invention. For example, if ink discharge handling regions for the respective recording heads 242 forming a pair are determined by taking a predetermined point in the X direction on the overlapping region R as the border, the arrangement region of one or more nozzles 244 of each of the recording heads 242, which form a pair, near the border is equivalent to the joint in the nozzle groups. As another example, if the nozzle groups of the recording heads 242, which form a pair, are arranged in such a way as not to overlap in the X direction, the arrangement region of one or more nozzles 244 of each of the recording heads 242 near the border between the nozzle groups is equivalent to the joint in the nozzle groups.

Further, in the above embodiment and modifications, the curve 71 shown in FIG. 6 is derived on the basis of the reading results of the test images 60 formed by the head unit 24 using different voltage correction values. Alternatively, the curve 71 may be derived from the reading results of images (density images) different from the test images 60.

Further, in the above embodiment and modifications, the center value of the reference range r is taken as the reference value D0, and the various determinations and processes are performed with the reference value D0. Instead of the reference value D0, a value that satisfies a predetermined discharge amount condition for the density of the test image 60 used in generating the ink discharge amount data may be used. The predetermined discharge amount condition may be, for example, being in the reference range r, or being in the reference range r and in a predetermined range from the center value of the reference range r.

Further, in the above embodiment and modifications, in order that the voltage correction values are set such that the ink discharge amounts of the recording heads 242 become as shown in C in FIG. 5, the voltage correction values are set such that the average value of all the ink discharge amounts of all the recording heads 242 matches the reference value D0. Instead of the average value, another representative value of all the ink discharge amounts of all the recording heads 242, for example, the median value, may be used.

Further, in the above embodiment and modifications, the image reader 26 of the inkjet recording device 1 reads the test image 60 recorded by the head unit 24. Alternatively, an image reading device provided externally to the inkjet recording device 1 may read the test image 60. Further, the external device 2 may perform the calculation of the ink discharge amounts and the generation of the ink discharge amount data based on the reading results of the test image 60.

Further, in the above embodiment and modifications, the conveyor drum 21 conveys the recording media P, but this is not intended to limit the invention. For example, the invention may be applied to an inkjet recording device that conveys the recording media P with a conveyor belt that is supported by two rollers and moves according to the rotation of the rollers.

Further, in the above embodiment and modifications, the inkjet recording device 1 forms images with the line head(s) in which nozzle groups are arranged to cover the image forming region in the X direction of the recording media P. Alternatively, the invention may be applied to an inkjet recording device that records images while causing recording heads to perform scanning.

Although some embodiments of the invention are described, the scope of the invention is not limited to the above embodiments, but includes the scope of the invention described in the scope of claims and the scope of their equivalents.

Although embodiments of the present invention have been described and illustrated in detail, the disclosed embodiments are made for purposes of illustration and example only and not limitation. The scope of the present invention should be interpreted by terms of the appended claims.

INDUSTRIAL APPLICABILITY

The invention is applicable to an inkjet recording device and an ink-discharge adjustment method for an inkjet recording device(s).

DESCRIPTION OF REFERENCE NUMERALS

1 Inkjet Recording Device
2 External Device
10 Sheet Feeder
11 Sheet Feeding Tray
12 Media Supply Unit
20 Image Recorder
21 Conveyor Drum
22 First Delivery Unit
23 Heater
24 Head Unit
241 Recording Head Drive Unit
241*a* Drive Control Circuit
241*b* Drive Circuit
242, 242*a* to 242*f* Recording Head
243 Recording Element
244 Nozzle
25 Fixing Unit
26 Image Reader
27 Second Delivery Unit
30 Sheet Receiver
31 Sheet Receiving Tray
40 Controller
41 CPU
42 RAM
43 ROM
44 Storage
51 Conveyor Drive Unit
52 Operational Display
53 Input/Output Interface
54 Bus
60 Test Image
70*a* to 70*f* Ink Discharge Amount
P Recording Medium
R Overlapping Region
r Reference Range

The invention claimed is:

1. An inkjet recording device comprising:

a recorder that discharges an ink to a recording medium from nozzles disposed in each of recording heads; and a hardware processor that performs, for the respective recording heads, setting relevant to adjustment of an amount of the ink to be discharged from nozzle groups each constituted of at least a part of the nozzles, which are disposed in each of the recording heads, wherein the recording heads are disposed such that arrangement regions of the nozzle groups in a predetermined direction, the nozzle groups corresponding to the respective recording heads, include regions different from one another, and ink dischargeable regions are connected to one another to be continuous in the predetermined direction, and the hardware processor performs:

a first adjustment operation in which, based on ink discharge amount information on a distribution in the predetermined direction of ink discharge amounts that are discharged from the nozzle groups based on image data having a predetermined density, the setting for the respective recording heads is performed such that at each joint of joints in the nozzle groups in the predetermined direction, a difference between representative values of the ink discharge amounts satisfies a predetermined continuity condition, each joint being formed by a pair of the nozzle groups, and a representative value of the ink discharge amounts of all the nozzle groups satisfies a predetermined discharge amount condition for the predetermined density; and after the first adjustment operation, a second adjustment operation in which at least a part of the setting, which has been performed for the respective recording heads, is adjusted such that a difference between a maximum value and a minimum value of the ink discharge amounts of the nozzle groups reduces.

2. The inkjet recording device according to claim 1, wherein the hardware processor takes, of the nozzle groups, a recording head having the ink discharge amount departing from a predetermined reference range as an adjustment target for which the setting is adjusted, and adjusts the setting for the recording head as the adjustment target such that the ink discharge amount is in the predetermined reference range.

3. The inkjet recording device according to claim 2, wherein in the second adjustment operation, the hardware processor adjusts the setting for, among the recording heads, a recording head other than the recording head as the adjustment target in a range in which at each joint of the joints in the nozzle groups, the difference between the representative values of the ink discharge amounts satisfies the predetermined continuity condition, each joint being formed by a pair of the nozzle groups.

4. The inkjet recording device according to claim 1, wherein the hardware processor performs the first adjustment operation and the second adjustment operation using a mathematical relation or table data showing a relationship between a set value relevant to an adjustment amount of the amount of the ink to be discharged and a magnitude of each of the ink discharge amounts.

5. The inkjet recording device according to claim 4, comprising:

a reader that reads an image recorded on the recording medium by the recorder, wherein the hardware processor causes the reader to read images having different densities and obtains the mathematical relation or the table data based on a result of the reading.

6. The inkjet recording device according to claim 1, comprising:

a reader that reads an image recorded on the recording medium by the recorder, wherein the hardware processor obtains the ink discharge amount information from a result of reading of a test image by the reader, the test image being recorded by the recorder based on predetermined test image data.

7. The inkjet recording device according to claim 6, wherein the hardware processor obtains, from the result of the reading of the test image by the reader, the ink discharge amount information containing a distribution of read densities of the test image relevant to the nozzle groups, the distribution corresponding to the distribution of the ink discharge amounts, and the hardware processor performs, in the second adjustment operation, adjusts the setting for the recording heads such that an added value of: a sum of differences each between an average value of each of the read densities relevant to the respective nozzle groups and a predetermined density reference value that satisfies a density condition corresponding to the predetermined discharge amount condition; and a sum of differences between representative values of the read densities at the respective joints in the nozzle groups, each of the joints being formed by a pair of the nozzle groups and the read densities being relevant to the respective nozzle groups, is a minimum.

8. The inkjet recording device according to claim 1, comprising:

a drive unit that supplies, to the recording heads, a drive waveform voltage signal that makes the ink to be discharged from each of the nozzles, which are disposed in each of the recording heads; and a drive controller that controls the voltage signal which is supplied by the drive unit to the recording heads, wherein the hardware processor performs the setting relevant to a correction amount of at least one of a magnitude of a voltage amplitude and a voltage applying duration of the voltage signal controlled by the drive controller.

9. The inkjet recording device according to claim 1, wherein the recorder includes a line head in which the nozzle groups are disposed in the predetermined direction to cover a recording width in the predetermined direction to the recording medium.

10. The inkjet recording device according to claim 1, comprising:

a mover that moves the recorder and the recording medium relative to one another, wherein the hardware processor causes the recorder to discharge the ink to the recording medium from the nozzle groups based on image data, thereby recording an image on the recording medium, the recording medium performing the relative movement in a predetermined moving direction that intersects the predetermined direction.

11. An ink-discharge adjustment method for an inkjet recording device including a recorder that discharges an ink to a recording medium from nozzles disposed in each of recording heads, comprising:

a setting step of performing, for the respective recording heads, setting relevant to adjustment of an amount of the ink to be discharged from nozzle groups each constituted of at least a part of the nozzles, which are disposed in each of the recording heads, wherein the recording heads are disposed such that arrangement regions of the nozzle groups in a predetermined direction, the nozzle groups corresponding to the respective recording heads, include regions different from one another, and ink dischargeable regions are connected to one another to be continuous in the predetermined direction, and the setting step includes:

a first adjustment step of, based on ink discharge amount information on a distribution in the predetermined direction of ink discharge amounts that are discharged from the nozzle groups based on image data having a predetermined density, performing the setting for the respective recording heads such that at each joint of joints in the nozzle groups in the predetermined direction, a difference between representative values of the ink discharge amounts satisfies a predetermined continuity condition, each joint being formed by a pair of the nozzle groups, and a representative value of the ink discharge amounts of all the nozzle groups satisfies a predetermined discharge amount condition for the predetermined density; and after the first adjustment step, a second adjustment step of adjusting at least a part of the setting, which has been performed for the respective recording heads, such that a difference between a maximum value and a minimum value of the ink discharge amounts of the nozzle groups reduces.

* * * * *